US005241449A

United States Patent [19]

Moeller et al.

[11] Patent Number: 5,241,449

[45] Date of Patent: Aug. 31, 1993

[54] RADON DECAY PRODUCT REMOVAL UNIT AS ADPATED FOR USE WITH A LAMP

[76] Inventors: Dade W. Moeller, 147 River Island Rd., New Bern, N.C. 28562; Stephen N. Rudnick, 33 George St., Newton, Mass. 02158

[21] Appl. No.: 823,148

[22] Filed: Jan. 21, 1992

[51] Int. Cl.[5] ..... H01T 23/00

[52] U.S. Cl. ..... 361/231; 361/213; 361/228; 362/253; 315/51; 315/70; 95/57; 95/81

[58] Field of Search ..... 55/66, 2, 101; 361/212, 361/213, 225, 226, 227, 228, 230, 231; 362/253; 315/34, 51, 70, 71, 111.81, 111.91, 178, 200 R

[56] References Cited

U.S. PATENT DOCUMENTS

| | | | |
|---|---|---|---|
| Re. 27,027 | 1/1971 | Cristofv et al. | 361/231 |
| 1,994,462 | 3/1935 | Bucno et al. . | |
| 2,744,865 | 5/1956 | Penning . | |
| 3,308,344 | 3/1967 | Smith et al. . | |
| 3,370,403 | 2/1968 | D'Elia et al. . | |
| 3,417,302 | 12/1968 | Leuder . | |
| 3,422,263 | 12/1968 | Asahina . | |
| 3,438,136 | 4/1969 | Raymond . | |
| 3,672,126 | 6/1972 | Goettle . | |
| 3,744,216 | 7/1973 | Halloran . | |
| 3,889,157 | 6/1975 | Von Berckheim | 361/231 |
| 4,376,642 | 3/1983 | Verity . | |
| 4,447,761 | 5/1984 | Stinnett . | |
| 4,596,585 | 6/1986 | Moeller et al. | 55/2 |

*Primary Examiner*—Jeffrey A. Gaffin

*Attorney, Agent, or Firm*—Hamilton, Brook, Smith & Reynolds

[57] ABSTRACT

A radon decay product remover for use in a conventional, residential lamp. The remover screws into the light bulb socket of a lamp and provides a replacement socket for a light bulb. The flow of electric current to the light bulb is controlled by an on-off switch in the radon decay product remover. When used in a table lamp, an ion generator includes electrodes (from which negative and/or positive ions are emitted) that attach to the exterior of the lamp shade.

19 Claims, 3 Drawing Sheets

RADON DECAY PRODUCT REMOVAL UNIT AS ADPATED FOR USE WITH A LAMP

BACKGROUND OF THE INVENTION

The greatest source of ionizing radiation exposure to the general public is from naturally occurring airborne radionuclides inside residences. All substances of natural origin, such as water, rock, soil and construction materials which incorporate crustal materials as aggregate, contain some amount of radium-226 which is a source of radon 222. Radon, being a non-reactive gas, is free to flow through porous soils and, eventually, may enter the environment within a building. Once inside a dwelling, radon will eventually decay into various radon decay products. The initial products in this decay chain series all have very short half lives (less than thirty minutes).

About ninety-five percent of the radon decay products, upon being formed, are positively charged. As a result, they tend to attract other polar molecules in the air, such as water and trace gases, and exist, at least temporarily, as very small and highly diffusive molecular clusters. Such clusters are generally referred to as "unattached" radon decay products. The airborne radioactive decay products also frequently collide with and attach themselves to particles within the air inside a dwelling. In this state, they are referred to as "attached" radon decay products. Such attachment is enhanced by the electrical charge of the radon decay products. Nonetheless, up to about twenty percent of the decay products will generally not attach to airborne particles and will remain in the unattached state, the degree of attachment being heavily dependent on the concentration of particles in the room air.

The health hazard associated with the radon decay series stems from the inhalation and deposition in the lungs of humans of both the attached and the unattached decay products. This is followed by their eventual decay and irradiation of the susceptible lung cell populations. The unattached decay products preferentially deposit in the upper segments of the lungs. This is the site within the lungs where most cancers have been observed among uranium miners who, in the course of their work, were exposed to relatively high concentrations of radon and airborne radon decay products. As a result, the unattached decay products are believed to have the potential for causing a higher localized dose to the lungs (and therefore have a higher associated risk) per unit amount of radioactive material inhaled. In contrast, the larger attached radon decay products are deposited rather uniformly throughout the respiratory system. For this reason, they are considered by radiobiologists to impose a lesser risk (by a factor of as much as 40) of health damage (cancer) per unit amount of radioactive material inhaled by the exposed individuals.

SUMMARY OF THE INVENTION

In accordance with the present invention, a radon decay product remover is provided for use in an electric lamp placed in a walled living enclosure having an airspace with radon decay products therein. The remover comprises a male electrical connector that screws into and couples to a standard light-bulb socket. The remover includes a positive and/or negative ion generator which produces a corona discharge consisting of ionized gas. The ion generator has two ion emitting electrodes. More or less can be used.

The ions, as produced, travel outward from the electrode(s) through the airspace to the room surfaces. As a result, an electric field gradient is generated and directed radially from the electrode(s). The electrical potential decreases from its maximum voltage at the electrode(s) to essentially zero voltage at the room surfaces. This, in turn, causes the airborne ions and radon decay products to migrate toward the boundaries of the airspace of said living enclosure where they deposit and are thereby removed from the airspace. The remover can be screwed into any standard light-bulb socket, for example, in a ceiling lamp, in a floor lamp, and in a table lamp. In the case of the use of the remover with a table lamp, the electrode(s) (e.g., brushes, from which the ions are emitted) are attached to the exterior of the lamp shade. This facilitates the emission and proper distribution of the ions produced by the ion generator.

The removal device also incorporates a high voltage direct current power supply for generating positive and/or negative ions. The positive corona, produced by a positive ion generator, results in the production of less ozone than the negative corona produced by a negative ion generator. This allows the positive ion generator to operate at higher voltages and to remove airborne radon decay products more efficiently. Through adjustment of the operating voltage of the ion generator, the accompanying production of ozone is kept at a minimum commensurate with proper operation of the removal device.

The above and other features of the invention including various novel details of construction and combinations of parts will now be more particularly described with reference to the accompanying drawings. It will be understood that the particular device embodying the invention is shown by way of illustration only and not as a limitation of the invention. The principles and features of this invention may be employed and varied in numerous embodiments without departing from the scope of the invention.

DETAILED DESCRIPTION OF THE INVENTION

Radon decay product removers have been attached to home ceiling fans. For example, U.S. Pat. No. 4,596,585 issued to Moeller et al. shows an ion generator inserted into a light-bulb socket of a ceiling fan. The invention discussed below is an improvement in the Moeller et al. device.

Figure 1:
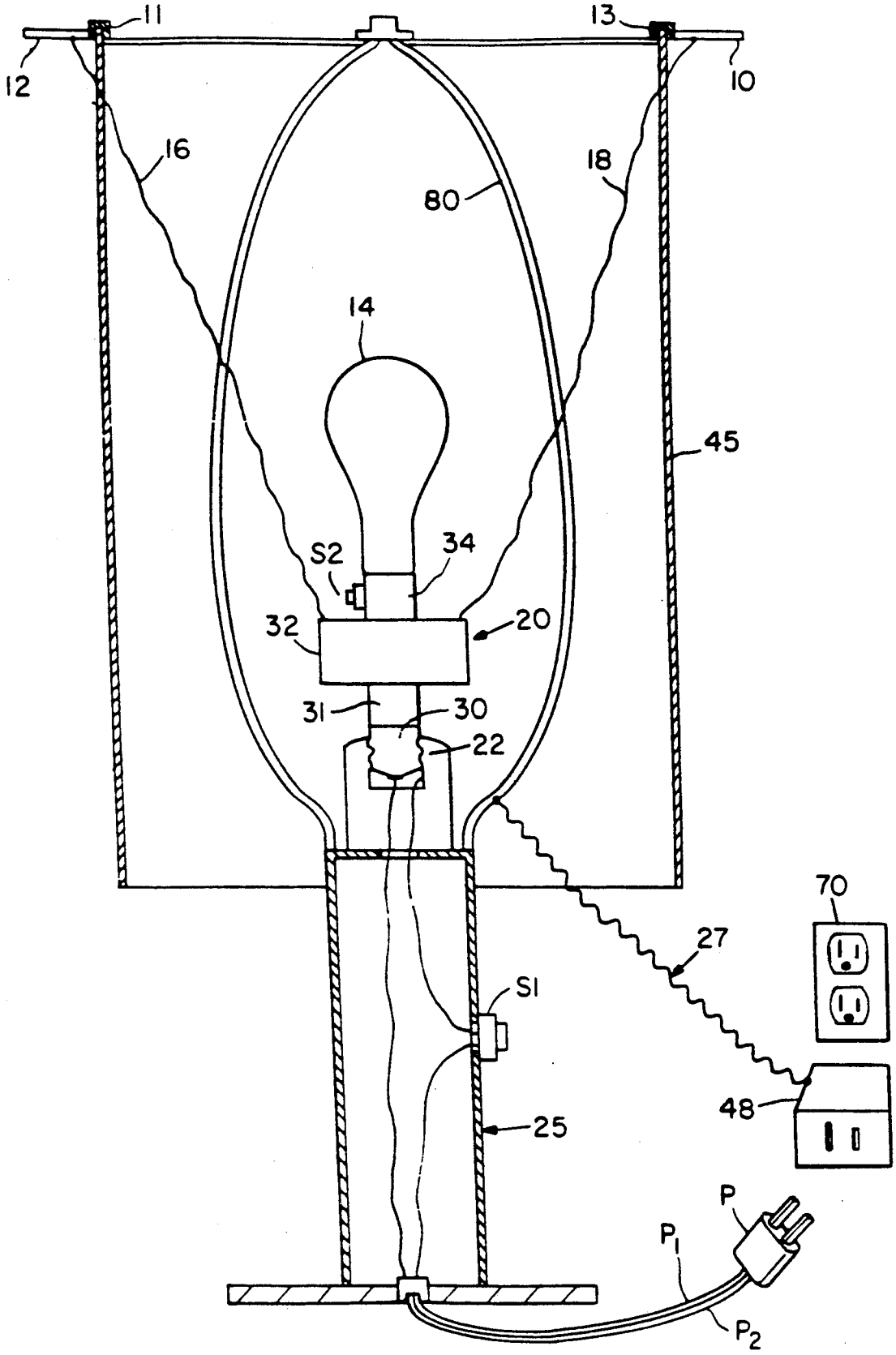
FIG. 1 is a cross-sectional front view of the radon decay product removal unit, as adapted and positioned in a table lamp.
Figure 3:
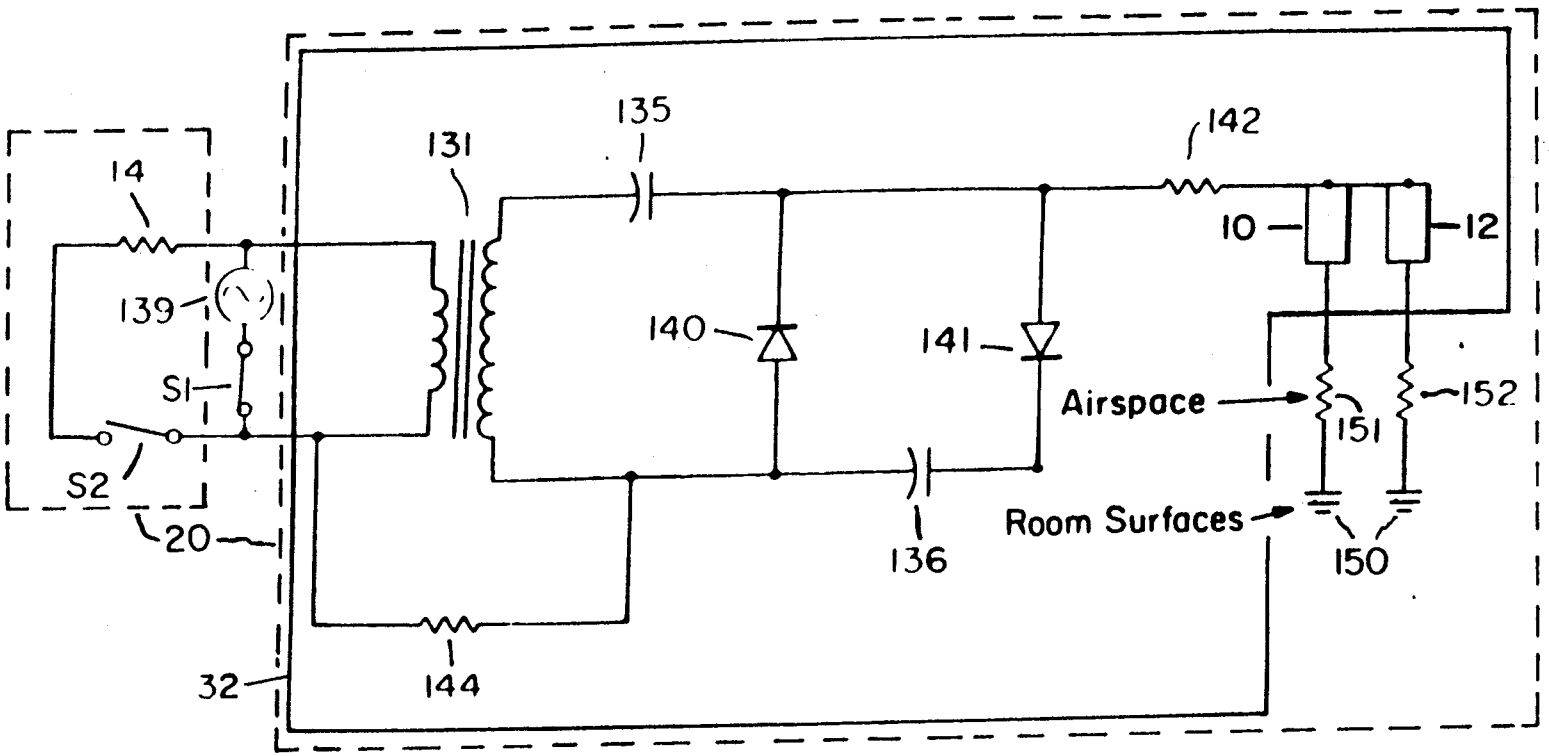
FIG. 3 illustrates a detailed schematic circuit diagram for the radon decay product remover, including the negative and/or positive ion generator of the invention and associated table lamp circuitry.

FIG. 1 illustrates the operation of the radon decay product remover as adapted and as positioned in a conventional table lamp. Conventional table lamp 25 uses a two prong polarized plug P to attach the lamp to a polarized three hole electrically grounded wall outlet 70. As will be explained below, adapter 48 couples plug P and grounding strap 27 to the wall outlet 70. Threaded female socket 22 is typically used for the insertion of a standard light bulb. However, the radon decay product remover 20 of the invention (which includes a negative and/or positive ion generator 32) is also configured to connect into socket 22. For example, threaded male segment 30 of the remover 20 screws into the threaded female socket 22 of lamp 25, as illustrated in FIG. 1. This connects remover 20 to power lines P1 and P2. Power supply 31 is provided in the remover to connect the household alternating current (AC) supply 139 on lines P1 and P2 to a step-up transformer 131 (See FIG. 3) contained within ion generator 32 that is capable of increasing the voltage to the range of 5,000 to 50,000 volts. The output from this transformer is then connected to a full wave rectifier comprising diodes 140 and 141 which convert the AC to direct current (DC), and to a filter comprising capacitors 135 and 136 which reduces the residual AC ripple voltage superimposed on the DC voltage. This system, in turn, provides sufficient smoothed AC electrical power to electrodes 10 and 12 of the negative and/or positive ion generator to generate an adequate flow of negative and/or positive ions. As shown in FIG. 3, the circuit is arranged to provide positive ions only.

The smoothed DC electrical current can also be passed through a voltage regulator (not shown) prior to being coupled through resistor 142 to electrodes 10 and 12 (FIGS. 1 and 3). The room surfaces are near ground potential and resistors 151 and 152 schematically represent the ion containing airspace between electrodes 10 and 12 and the room surfaces (shown as ground 150 in FIG. 3).

The radon decay produce remover, as adapted, includes a socket 34 into which a light bulb can be inserted, and a switch S2 to provide electrical current to the light bulb as required. The standard lamp switch S1 is left on permanently, and the normal off-on function of the table lamp (or light bulb) is maintained by switch S2. The heat produced by light bulb 14 (schematically depicted in FIG. 3 as a resistor) produces natural convective air currents, much like those produced by a small fan. These currents aid in the distribution of positive and/or negative ions and radon decay products and facilitate their removal through deposition on surfaces within the rooms. Studies show that the combination of convection and the production of ions by ion generator 32 is synergistic—that is, the combination is more effective in removing airborne radon decay products than the sum of the two units operating (or the two processes being applied) independently. It should be noted, however, that the invention described here is still effective even with the light bulb switch S2 turned off.

The operation of remover 20 causes the build up of charges on all surfaces contained within a volume defined by the lamp shade. This can cause noise, sparking, and interference with electronic devices connected into the same electrical circuit as outlet 70. Electrically grounding the metal parts of the table lamp eliminates these charge effects but, because grounded surfaces also attract ions, radon decay product removal would be compromised. Thus, not only should the electrodes be outside the lamp shade, but also there should not be any direct (unobstructed) "line-of-sight" pathway between the electrodes and the grounded metal components of the table lamp.

Figure 2:
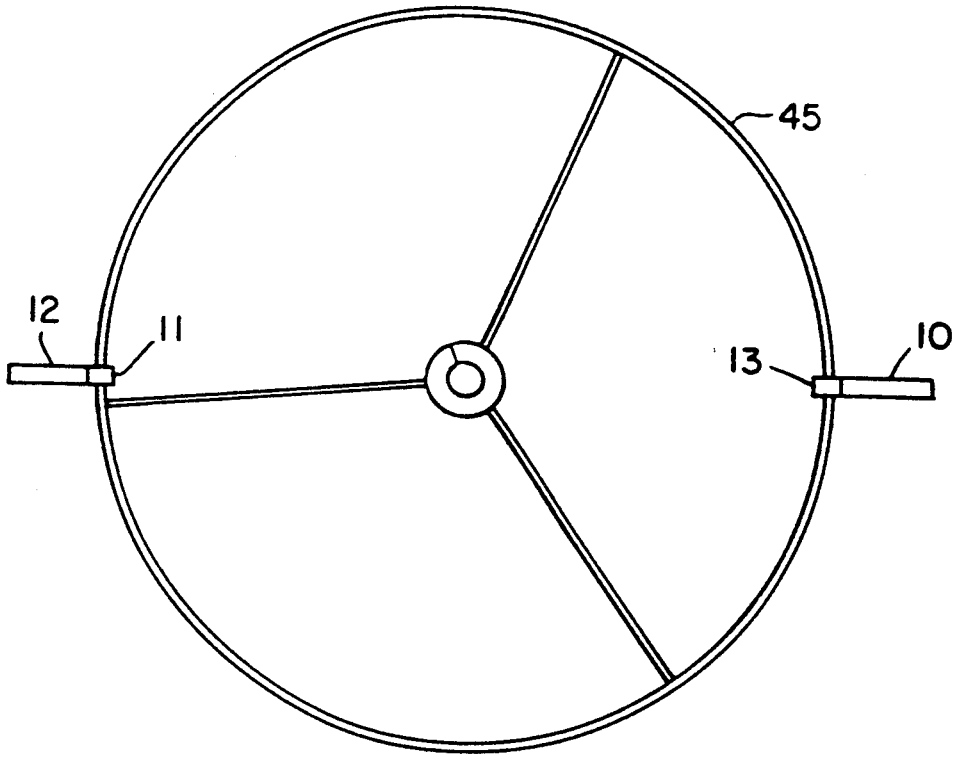
FIG. 2 is a vertical or top view of the removal device of the invention which illustrates a typical placement of the ion generator electrodes (in this case, brushes) on the exterior of a table lamp shade.

Ions cannot pass through lamp shade 45, but more importantly, if the electrodes are inside the shade the ions will rapidly move to non-electrical metal components of the lamp and lamp shade instead of out into the room and migrating toward room surfaces. For this reason, the electrodes or brushes of the remover 20 should be positioned on the outside of shade 45, as shown in FIGS. 1 and 2. To achieve this configuration, electrode 12 is attached to shade 45 by insulated electrical connector 11 and electrode 10 is coupled to shade 45 by insulated electrical connector 13. This facilitates the movement of ions away from the lamp and towards the boundaries (surfaces) of the room. electrical connections are effected by high-tension wire 16 which couples electrode 12 to remover 20, and by high-tension wire 18 which couples electrode 10 to remover 20, as shown in FIG. 1. Insulated grounding strap 27 couples harp 80 to adapter 48 which, in turn, connects the harp to the building electrical ground (FIG. 1). Grounding strap 27 can be located more conveniently and inconspicuously if physically attached to wires P1 and P2, which provide electrical current to the table lamp.

In a table lamp embodiment where the lamp is located next to a wall of a room, and particularly if it is located in a corner, the electrodes should not only be positioned outside the lamp shade but should also be placed toward the open portions of the room, not toward the wall or corner. This assures dispersal of the ions and proper radon decay product removals.

The following components would normally be included as an integral part of the grounding strap: (1) a means for firm attachment of one end of the strap to the cylindrically shaped rod from which the harp of the lamp is constructed, and (2) an adapter at the other end of the strap into which the polarized lamp cord is plugged and which itself can be plugged into the polarized three hole electrical wall outlet, thereby providing power to the table lamp and radon decay product remover while simultaneously grounding the lamp. For certain uses, where the lamp has a three-prong plug, such a strap (or connector) is not needed.

To avoid an electrical shock from the ion emitting electrodes, the circuitry for the ion generator (FIG. 3) includes redundant current limiting 200 picofarad capacitors 135 and 136, plus a 22 megohm resistor 142 in series with the ion generator output. Resistor 144 is a one megohm resistor for providing a reference to virtual ground.

In the preferred embodiment, a positive ion generator is used in the radon decay product removal unit of the invention. However, a negative ion generator can be substituted for the positive ion generator. To effect a negative ion generator, the direction of diodes 140 and 141 in FIG. 3 must be reversed. While the radon decay product removal effectiveness of a negative ion generator unit is less than that for a positive ion generator unit operating at the same DC voltage, the removal capability provided by a negative ion unit is still substantial.

The positive corona, produced by a positive ion generator, results in the production of less ozone than the negative corona produced by a negative ion generator. This permits the positive ion generator to be operated at higher voltages with additional improvements in its effectiveness for the removal of airborne radon decay products.

As noted above, the electrical ground of the table lamp avoids the build up of charges on the metal surfaces within the volume described by the lamp shade.

However, electrical grounding is not needed if the electrodes are more than approximately 1 meter from the metallic ungrounded parts of the table lamp.

In summary, either the non-electrical metal parts of the lamp must be electrically grounded or the electrodes must be located remotely from the lamp.

Equivalents

Those skilled in the art will recognize, or be able to ascertain using no more than routine experimentation, many equivalents to the specific embodiment of the invention described herein. The ion generator of the invention is not limited to use in a table lamp; it can be used in any lamp fixture in a room. For example, the ion generator of the invention can be placed in an overhead ceiling fan, in a floor lamp, or in a ceiling lamp.

These and all other equivalents are intended to be encompassed by the following claims.

We claim:

1. A radon decay product remover for use in a walled living enclosure having an airspace with radon decay products therein, comprising:

a) a threaded male adapter for insertion into a light bulb socket so as to connect the radon decay product remover to an A.C. electrical power supply;

b) an ion generator in said remover and coupled through said adapter to said A.C. power supply, said ion generator having an A.C. to D.C. converter, including a rectifier for rectifying said A.C. power to produce high voltage D.C. power which is coupled to an electrode for creating ions that are distributed in said airspace, resulting in an electric field gradient such that the electrical potential decreases from its maximum voltage at the electrode to essentially zero voltage at the room surfaces causing migration of ions and charged airborne radon decay products toward the boundaries of the airspace of said living enclosure where they deposit on surfaces and are thereby removed from the airspace, c) a female socket for insertion of a light bulb, said female socket being electrically coupled to said A.C. power supply through said adapator.

2. A remover, as recited in claim 1, wherein the ion generator is a positive ion generator.

3. A remover, as recited in claim 1, wherein the ion generator is a negative ion generator.

4. A remover, as recited in claim 1, wherein the electrode is coupled to an exterior of a table lamp shade encircling said bulb.

5. A remover, as recited in claim 4, further comprising:

a connector for coupling a non-electrical metal component associated with the lamp and lamp shade to an electrical ground to prevent the build up of charge on the lamp and lamp shade surfaces.

6. A remover, as recited in claim 4, wherein the electrode is fixed more than approximately one meter from a non-electrical metallic ungrounded component of the lamp shade.

7. A remover, as recited in claim 1, wherein the converter further comprises:

a transformer including an input coil, coupled to an AC voltage, and an output coil coupled to said rectifier;

and a filter, coupled to said rectifier for filtering the rectified A.C. power.

8. A remover, as recited in claim 1, wherein the female socket is mounted on the remover and the heat from the light bulb generates natural convective air currents which enhance migration of decay products.

9. A radon decay product remover for use in a walled living enclosure having an airspace with radon decay products therein, comprising:

a) a threaded male adaptor for insertion into a light bulb socket for coupling the radon decay product remover to a source of AC power;

b) an ion generator electrically coupled to said adapter and having a converter for converting the A.C. power to D.C. power to generate high voltage D.C. power which is coupled to an electrode for creating a spatial distribution of airborne ions in said airspace resulting in an electric field gradient directed radially from the electrode for causing migration of ions and charged airborne radon decay products toward the boundaries of the airspace of said living enclosure where they deposit on surfaces and are thereby removed from the airspace;

c) a female threaded socket mounted on said remover and electrically coupled to said source of AC power through said male adapter for insertion of a light bulb, the heat from which generates natural convective air currents assisting in said migration;

d) a lamp shade encircling said light bulb and metal surfaces on said lamp and lamp shade; and e) a connector for coupling said metal surfaces on the lamp and lamp shade to an electrical ground to prevent the build up of charge on the metal surfaces of the lamp and lamp shade, and wherein the electrode is coupled to an exterior portion of the lamp at a location having no direct line-of-sight pathway between the electrode and the metal surfaces of the lamp or lamp shade.

10. A remover, as recited in claim 9, wherein the ion generator is a positive ion generator.

11. A remover, as recited in claim 9, wherein the ion generator is a negative ion generator.

12. A remover, as recited in claim 9, wherein the convertor comprises:

a transformer including an input coil, coupled to said AC power, and an output coil;

a rectifier including an input, coupled to said transformer output coil, and an output;

a filter including an input, coupled to said rectifier output, and an output which comprises said D.C. power.

13. A radon decay product remover for use in a walled living enclosure having an air space with radon decay products therein, comprising:

a) a threaded male adapter for inserting into a standard light bulb socket for coupling radon decay product remover to a source of AC power;

b) an ion generator having a rectifier for converting said AC power to high voltage DC power, which DC voltage is coupled to at least one electrode for creating a spatial distribution of airborne ions in said airspace resulting in an electric field gradient directed radially from the electrode for causing migration of ions and charged airborne radon decay products toward the boundaries of the airspace of said living enclosure where they deposit on surfaces and are thereby removed from the airspace;

c) a female threaded socket mounted on said remover and electrically coupled to said source of AC power for insertion of a light bulb, which generates natural convective air currents to enhance said migration;

d) a lamp shade for mounting about said bulb;

e) a connector for coupling a metal component on the shade to an electrical ground to prevent the build up of charge on the metal surfaces of the lamp and lamp shade and wherein the electrode is coupled to an exterior portion of the lamp shade.

14. A method of reducing the quantity of airborne radon decay products in a walled living enclosure having an air space comprising the steps of:

a) circulating air in the space by convection currents generated by heat from a light bulb;

b) concurrent with circulating air, generating ions from an electrode of an ion generator into the airspace and creating a spatial distribution of airborne ions in said airspace resulting in an electric field gradient directed radially from the electrode for causing migration of ions and charged airborne radon decay products toward the boundaries of the airspace of said living enclosure where they deposit on surfaces and are thereby removed from the air space; and c) coupling AC power to both said light bulb and said ion generator.

15. A method, as recited in claim 14, wherein the convection currents enhance the migration of ions.

16. A method, as recited in claim 14, wherein the ion generator is a positive ion generator.

17. A method as recited in claim 14, wherein the ion generator is a negative ion generator.

18. A method as recited in claim 14 wherein the ion generator generates both negative and positive ions.

19. A remover, as recited in claim 9 wherein the lamp and lamp shade have metallic parts and no direct line-of-sight pathway is provided between the electrode and the metallic parts.

* * * * *